US009140145B1

(12) United States Patent
Brady et al.

(10) Patent No.: US 9,140,145 B1
(45) Date of Patent: Sep. 22, 2015

(54) PH ADJUSTMENT OF POWER PLANT COOLING WATER WITH FLUE GAS/FLY ASH

(75) Inventors: Patrick V. Brady, Albuquerque, NM (US); James L. Krumhansl, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 71 days.

(21) Appl. No.: 13/207,830

(22) Filed: Aug. 11, 2011

(51) Int. Cl.

| | |
|---|---|
| ***F02G 1/00*** | (2006.01) |
| ***F01K 13/00*** | (2006.01) |
| ***F01K 9/00*** | (2006.01) |
| ***F01K 17/00*** | (2006.01) |
| ***F22D 5/28*** | (2006.01) |
| ***F23B 90/00*** | (2011.01) |
| ***F01K 17/04*** | (2006.01) |
| ***F01K 25/14*** | (2006.01) |

(52) U.S. Cl.
CPC ..... *F01K 13/00* (2013.01); *F01K 17/00* (2013.01); *F01K 17/04* (2013.01); *F01K 25/14* (2013.01)

(58) Field of Classification Search
CPC ..... F01K 13/00; F01K 17/00; F01K 17/04; F01K 25/14
USPC ..... 60/39.03, 105, 39.25, 645, 39.5, 685, 60/39.182; 210/638, 104; 122/7 R, 406.1, 122/421, 448.2, 1 R, 420, 451.2; 96/351; 110/342
See application file for complete search history.

(56) References Cited

U.S. PATENT DOCUMENTS

| | | | | | |
|---|---|---|---|---|---|
| 3,693,557 | A * | 9/1972 | Makuch | 110/342 |
| 4,121,541 | A * | 10/1978 | Kneissl et al. | 122/1 R |
| 4,126,000 | A * | 11/1978 | Funk | 60/648 |
| 4,347,704 | A * | 9/1982 | Marquardt et al. | 60/648 |
| 4,489,679 | A * | 12/1984 | Holt | 122/451 S |
| 4,547,294 | A * | 10/1985 | Goeldner | 210/697 |
| 4,660,511 | A * | 4/1987 | Anderson | 122/420 |
| 5,722,821 | A * | 3/1998 | Christenson | 431/10 |
| 7,514,001 | B2 | 4/2009 | Costa et al. | |
| 7,537,702 | B2 * | 5/2009 | Lupton et al. | 210/652 |
| 8,236,093 | B2 * | 8/2012 | Taylor et al. | 95/273 |
| 2002/0053196 | A1 * | 5/2002 | Lerner et al. | 60/39.182 |
| 2003/0145596 | A1 * | 8/2003 | Noelscher | 60/670 |
| 2007/0175333 | A1 * | 8/2007 | Shoemaker et al. | 96/243 |
| 2009/0084728 | A1 * | 4/2009 | Kirts | 210/638 |
| 2011/0014578 | A1 * | 1/2011 | Rohde et al. | 431/75 |
| 2011/0051880 | A1 * | 3/2011 | Al-Mayahi et al. | 376/370 |
| 2011/0083437 | A1 * | 4/2011 | Ast et al. | 60/671 |

* cited by examiner

*Primary Examiner* — Kenneth Bomberg
*Assistant Examiner* — Deming Wan
(74) *Attorney, Agent, or Firm* — Daniel J. Jenkins

(57) ABSTRACT

A system including a vessel including a heat source and a flue; a turbine; a condenser; a fluid conduit circuit disposed between the vessel, the turbine and the condenser; and a diverter coupled to the flue to direct a portion of an exhaust from the flue to contact with a cooling medium for the condenser water. A method including diverting a portion of exhaust from a flue of a vessel; modifying the pH of a cooling medium for a condenser with the portion of exhaust; and condensing heated fluid from the vessel with the pH modified cooling medium.

18 Claims, 1 Drawing Sheet

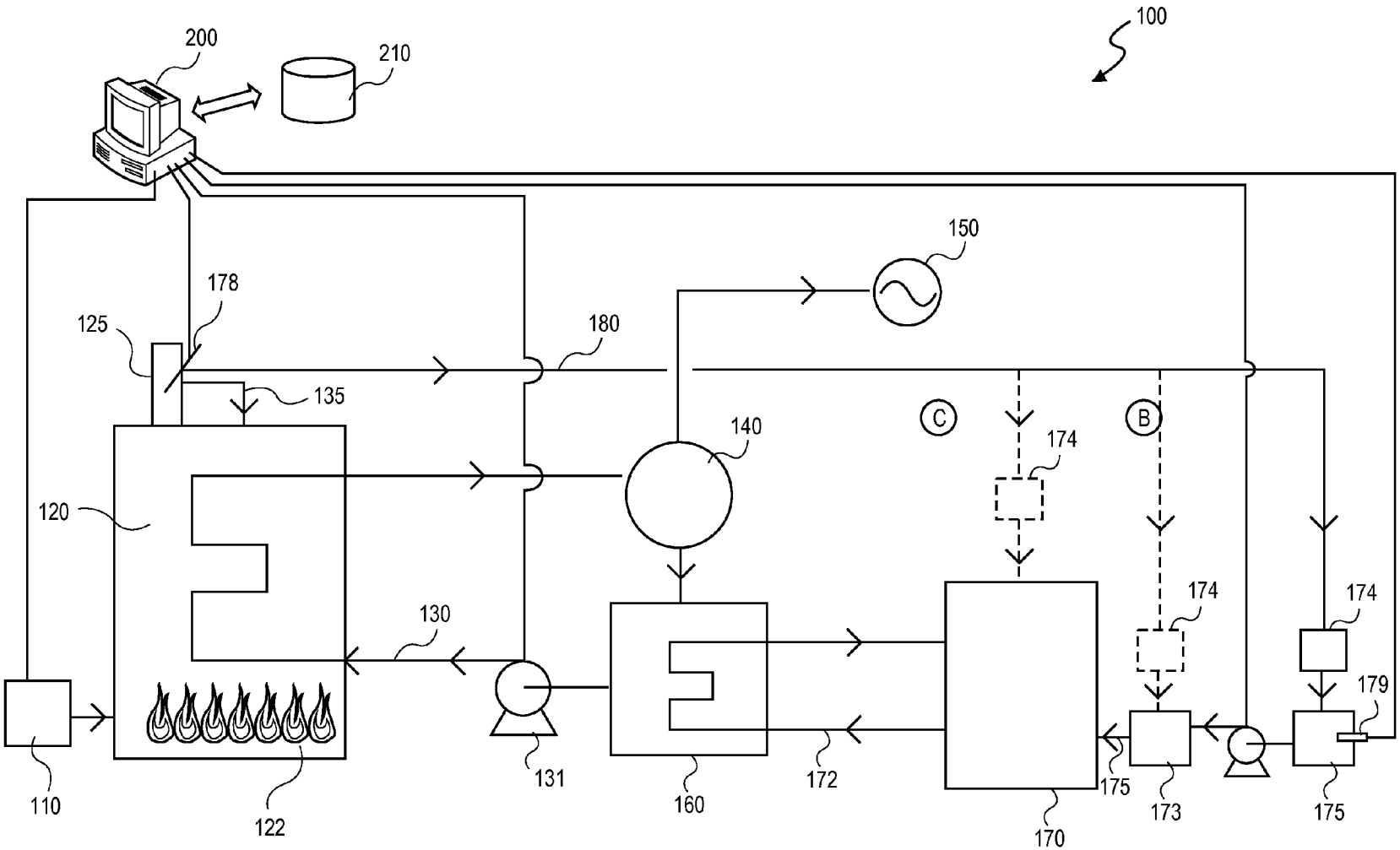
100
200
210
150
140
180
178
135
125
120
122
130
131
110
160
172
170
174
175
173
179
B
C

PH ADJUSTMENT OF POWER PLANT COOLING WATER WITH FLUE GAS/FLY ASH

STATEMENT REGARDING FEDERALLY SPONSORED RESEARCH

This invention was developed under Contract DE-AC04-94AL85000 between Sandia Corporation and the U.S. Department of Energy. The U.S. Government has certain rights in this invention.

FIELD

Power plant operation.

BACKGROUND

A fossil fuel power plant is a system that burns fossil fuel such as coal, natural gas or petroleum to produce electricity. Most power plant systems convert fossil fuel energy to mechanical or electric energy by burning fuel (coal, natural gas or petroleum) in a vessel (e.g., a boiler) and circulating a working fluid such as water through the boiler. In the case of water as the working fluid, the fuel converts the water to high temperature and pressure steam and the steam in turn is used to do work in the form of rotating a turbine shaft. The steam does work as it expands through the turbine. The rotation of the shaft is then converted to electrical energy from a generator. From the turbine, the working fluid is transferred to a condenser where it is condensed by, for example, a heat exchange process. The working fluid (condensate) is then cycled back into the heating vessel.

The main purposes of the condenser are to condense the working fluid (e.g., steam) from the turbine for reuse in the cycle and to maximize turbine efficiency by maintaining proper vacuum. One type of condenser used in power plant systems is a shell and tube heat exchanger. As heat exchangers, these condensers convert the working fluid (e.g., steam) from a gaseous to liquid state by a cooling medium (e.g., water) at atmospheric pressure or below atmospheric pressure. The working fluid (e.g., steam) from the turbine flows on the shell side of the condenser, while the cooling medium flows in the tube side. Most of the heat liberated due to condensation of the working fluid is carried away by the cooling medium (e.g., water). The condensed working fluid (condensate) is collected in the bottom of the condenser (in a hot well) and then pumped back to the heating vessel (e.g., boiler) to repeat the cycle.

A large volume of cooling medium (e.g., water) must be circulated through the tubes of the condenser to absorb the heat from the working fluid (e.g., steam). As the steam cools and condenses, the temperature of the cooling water rises. The waste heat generated at the condenser is released to the atmosphere through a cooling tower associated with the condenser.

Water-based cooling systems fall in either once-through or closed-loop designs. Once-through cooling systems withdraw a large volume of water from river, lake, estuary or ocean. The water is pumped through a condenser in a single pass and returned to the same or nearby water body.

Closed-loop cooling systems receive their cooling water from a cooling tower and basin, cooling pond or cooling lake that is typically associated with a river, lake, estuary or ocean as a water source. Because evaporation in plant cooling towers removes cooling water from the evaporated system, regular additions of "make-up" cooling water are needed from the source. Make-up volumes are much lower than daily once-through volumes and may range from hundreds of thousands to millions of gallons per day.

Recently, to meet cooling water demands, particularly in closed-cycle cooling systems, the power plant industry has looked to reclaimed water as an additional source. Reclaimed water includes domestic and industrial wastewaters, such as water from oil and gas wells, mine pool waters, produced water from carbon dioxide storage in saline formations, and ash pond basins.

Corrosion and the build up of scale in a condenser caused by the cooling medium (e.g., water) is a concern.

BRIEF DESCRIPTION OF THE DRAWINGS

FIG. 1 shows a schematic embodiment of a power plant system.

DETAILED DESCRIPTION

FIG. 1 shows a schematic of an embodiment of a power plant system. System 100 includes vessel or boiler 120 containing heat source 122. Fuel source 110 is connected to vessel 120 to provide fuel to the vessel. In one embodiment the fuel source is natural gas or coal. Extending through vessel 120 is fluid conduit circuit 130. In one embodiment, fluid conduit circuit 130 provides purified water to vessel 120. The purified water is converted to steam inside vessel 120 by combustion of fuel from fuel source 110. Fluid conduit circuit 130 transports the steam from vessel 120 to turbine 140.

From turbine 140, fluid conduit circuit 130 connects to condenser 160. In condenser 160, the steam within fluid conduit circuit 130 is condensed for reuse. One way steam is condensed is through a heat exchange or similar process in which the steam is cooled by a cooling medium, such as cooling water. FIG. 1 shows condenser 160 having fluid conduit circuit 130 extending therein. Also extending into condenser 160 is cooling conduit circuit 172. Cooling conduit circuit 172 contains a cooling medium such as water.

In one embodiment, condenser 160 includes a heat exchanger with, for example, a number of tube sheets. Steam from fluid conduit circuit 130 is introduced to a shell side of the heat exchanger with the cooling fluid supplied to the tube or bore side (through the tube sheets). The cooling fluid condenses the steam to a condensate that may be returned to vessel 120 via pump 131.

In one embodiment, the cooling medium that is introduced into condenser 160 and is used to cool/condense the working fluid in fluid conduit circuit 130 is supplied from cooling tower 170 through cooling conduit circuit 172. From condenser 160, the cooling fluid is returned to cooling tower 170. In one embodiment, the cooling fluid is water, such as fresh water, salt water or reclaimed water. Some of the water that is introduced to condenser 160 is lost to evaporation from cooling tower 170 and the remaining water is recycled for reuse in cooling fluid conduit circuit 130. Make-up water supplied to cooling tower 170 from a water source make up for the water lost to evaporation indicated as cooling medium source 175.

Referring to vessel 120 (e.g., boiler), the vessel includes flue 125. Flue 125 is in communication with an interior of vessel 120 and is used to disperse combustion gases generated by combusting the fuel from fuel source 110 (e.g., natural gas, coal, etc.). In one embodiment, a portion of the exhaust from flue 125 is diverted by way of a diverter 178 in flue 125. Diverter 178 is, for example, a damper that directs a portion of the exhaust into conduit 180. Conduit 180 is, for example, a tube or other shaped duct having interior dimension(s) to allow a volume of exhaust (gas) therethrough. Conduit 180 is directed into cooling medium source 175 that supplies cooling medium to condenser 160. As noted above, water as a cooling medium, whether fresh, salt or reclaimed or some combination thereof may form calcium carbonate and/or silica scale when mixed with or in contact with components (e.g., metal components) of condenser 160 (e.g., tube sheets). Scale tends to be produced when the water is at a pH greater than 7.0 (e.g., pH of 8-9). One way to reduce the formation of scale in cooling tower 170 and condenser 160 is to lower the pH. In the case of a combustion source for vessel 120 that is natural gas, an exhaust through flue 125 contains carbon dioxide ($CO_2$) and possibly other substances such as nitrogen, oxides of nitrogen. Carbon dioxide can function as a weak acid when combined with water. By diverting a portion of exhaust from flue 125 into the cooling medium source (e.g., water) to condenser 160, the pH of the cooling medium that enters condenser 160 may be decreased. Corrosion and silica scale can also be inhibited by raising the pH of water above a pH of 8-9. In the case of a coal-fired power plant, the exhaust through a combustion flue (e.g., flue 125) contains coal ash. Coal ash is commonly a mixture oxide of metals (e.g., calcium silicate) that tends to be basic when mixed with water. By exposing a cooling medium source (e.g., water) to coal ash, the pH of the cooling medium that enters condenser 160 may be increased.

FIG. 1 shows conduit 180 extending from flue 125 to cooling medium source 175 to mix with a cooling medium (e.g., water) in cooling medium source 175 prior to the cooling medium entering cooling tower 170 as, for example, make-up water. Conduit 180 supplies exhaust from flue 125 into cooling medium source 175. In one embodiment, where cooling medium source 175 stores water in a reservoir, exhaust from flue 125 may be supplied by terminating conduit 180 in cooling medium source 175. Representatively, conduit 180 may be an aluminum tube having an end disposed in cooling medium source 175 such as below a minimum level requirement for a reservoir. In this manner, the exhaust can mix with water in cooling medium source 175.

FIG. 1 also shows optional filter 174 connected to conduit 180 at a position proximal to cooling medium source 175. Filter 174 may be used to trap particulates or other unwanted gas components in the exhaust diverted from flue 125 before the exhaust is mixed with cooling medium in cooling medium source 175. To trap particulates, filter 174 contains, for example, a cordierite, silicon carbide, or ceramic fiber filter core.

In another embodiment (shown in dashed lines marked B), conduit 180 in system 100 may supply exhaust from flue 125 into reverse osmosis filtration unit 173. Osmosis filtration unit 173 may be used to remove salts (e.g., dissolved salts) that might otherwise cause scaling of cooling tower 170. FIG. 1 shows reverse osmosis filtration unit 173 disposed between cooling medium source 175 and cooling tower 170 to treat water supplied to cooling tower 170. In another embodiment, water in cooling tower 170 may be connected to reverse osmosis filtration unit 173 so that the water receives continuous filtration. In either embodiment, conduit 180 brings exhaust from flue 125, optionally through filter 174, and into reverse osmosis filtration unit 173 so that the exhaust mixes with water in the filtration unit.

In another embodiment (shown in dashed lines marked C), conduit 180 in system 100 may supply exhaust from flue 125 into cooling tower 170 to be mixed with the cooling medium (e.g., water) present in cooling conduit circuit 172. In an example of a cooling tower used to cool a cooling medium of water, heated water from condenser 160 is directed to cooling tower 170. In cooling tower, the heated water is exposed to an air draft to cool the water. The cooled water is then collected in a collection basin for use in cooling conduit circuit 172. In an embodiment where exhaust from flue 125 is supplied to cooling tower 170, conduit 180 may extend from flue 125 into a collection basin in cooling tower 170 where it can be mixed with water present in the system.

In another embodiment, conduit 180 in system 100 may supply exhaust from flue 125 into multiple locations. For example, exhaust from flue 125 may be diverted into cooling medium source 175 and into cooling tower 170 (path marked C) and/or into reverse osmosis filtration unit 173 (path marked B). In another embodiment, exhaust from flue 125 can be diverted to one or more of these locations at different times in an electricity producing process. For instance, in a natural gas-fired power plant using water as a cooling medium, exhaust from flue 125 might initially be introduced at cooling medium source 175. If during processing, a pH of water in cooling tower 170 is found to be a pH 8 or greater, the exhaust could be directed to the cooling tower (path marked C). In another embodiment, exhaust from flue 125 is introduced at any commercially and mechanically feasible location where it can mix with a cooling medium for condenser 160 and modify a property of the cooling medium (e.g., change the pH of the cooling medium).

In one embodiment, a system of diverting a portion of the exhaust from a power plant flue may include an automated sample processing system. FIG. 1 shows control computer 200 in communication with the various system components to provide a centralized user interface for controlling the components in a power plant operation process. It shall be appreciated that control computer 200 and the various system components may be configured to communicate through hardwires or wirelessly, for example, the system may utilize data lines which may be conventional conductors or fiber optic.

Control computer 200 may also communicate with one or more local databases 210 so that data or protocols may be transferred to or from local database(s) 210. For example, local database 210 may store one or a plurality of operation protocols that are designed to be performed by the components of system 100. Furthermore, control computer 200 may use local database(s) 210 for storage of information received from components of system 100, such as reports and/or status information.

Representatively, as described above, vessel 120 is used, in one embodiment, to produce high pressure steam suitable for rotating turbine 140 and generating electricity 150. In producing the steam in vessel 120, exhaust is generated at flue 125 and a portion of that exhaust is diverted through diverter 178 to be mixed with cooling medium for condenser 160. In one embodiment, the volume of exhaust may be monitored and/or controlled by control computer 200. For example, a processing protocol delivered to control computer 200 includes instructions for generating steam in vessel 120. These instructions are provided in a machine-readable form to be executed by control computer 200. Accordingly, control computer 200 executes the instructions to meter the components into vessel 120 (e.g., fuel from fuel source 110, water for circuit 130). Such metering is controlled and monitored by control computer 200 by, for example, opening/controlling a valve to deliver fuel from fuel source 110 and powering/controlling a pump in circuit 130. Similarly, in one embodiment, control computer 200 executes instructions to control a flow of cooling medium into condenser 160 and into cooling tower 170 (e.g., from cooling medium source 175).

Based on the fuel consumption and steam production in vessel 120, control computer can determine the volume of exhaust produced at an exit of flue 125. Control computer 200 can then control diverter 178 to divert a portion of that volume into conduit 180 to mix with the cooling medium (e.g., water). Where the cooling medium is water, in one embodiment, a pH of cooling medium source 174 is measured at regular intervals with pH monitor 179 during processing of electricity. Control computer 200 regulates the volume of exhaust that is diverted through conduit 180 based on a pH reading at cooling medium source 175. In a natural gas-fired power plant, for example, the exhaust from flue may be used to lower the pH of water to inhibit scale and/or corrosion. Representatively, if a reading of pH of water at cooling medium source 175 is pH 8, control computer 200 may execute program instructions to open diverter 178 to divert a greater volume of exhaust from flue 125 into cooling medium source 175. If a reading of pH of water at cooling medium source 175 is pH 6, control computer may be programmed to maintain a position of diverter 178 so that the pH stays approximately pH 6 or execute program instructions to close diverter 178 to raise the pH slightly. In one embodiment, control computer 200 may contain programmed instructions allowing for a range of acceptable pH readings (e.g., pH 6.5-7.5 for natural gas-fired power plant). Obtaining feedback from cooling medium source 175 allows program instructions in control computer 200 to be executed to seek to stay within the acceptable range and inhibit scale in condenser 160 and cooling tower 170, by seeking to achieve, in one embodiment, an optimal pH of water in cooling medium source 175. It is appreciated that control computer 200 may be used to control and monitor additional components of system 100 that may or may not have to do with cooling medium source 175.

In the description above, for the purposes of explanation, numerous specific details have been set forth in order to provide a thorough understanding of the embodiments. It will be apparent however, to one skilled in the art, that one or more other embodiments may be practiced without some of these specific details. The particular embodiments described are not provided to limit the invention but to illustrate it. The scope of the invention is not to be determined by the specific examples provided above but only by the claims below. In other instances, well-known structures, devices, and operations have been shown in block diagram form or without detail in order to avoid obscuring the understanding of the description. Where considered appropriate, reference numerals or terminal portions of reference numerals have been repeated in the FIGURE to indicate corresponding or analogous elements, which may optionally have similar characteristics.

It should also be appreciated that reference throughout this specification to "one embodiment", "an embodiment", "one or more embodiments", or "different embodiments", for example, means that a particular feature may be included in the practice of the invention. Similarly, it should be appreciated that in the description, various features are sometimes grouped together in a single embodiment, FIGURE, or description thereof for the purpose of streamlining the disclosure and aiding in the understanding of various inventive aspects. This method of disclosure, however, is not to be interpreted as reflecting an intention that the invention requires more features than are expressly recited in each claim. Rather, as the following claims reflect, inventive aspects may lie in less than all features of a single disclosed embodiment. Thus, the claims following the Detailed Description are hereby expressly incorporated into this Detailed Description, with each claim standing on its own as a separate embodiment of the invention.

What is claimed is:

1. A method comprising:

diverting a portion of exhaust gas from a flue of a vessel;

directly modifying the pH of a cooling medium for a condenser with the portion of exhaust gas; and condensing a fluid heated in the vessel and used to power a turbine with the pH modified cooling medium in a condenser.

2. The method of claim 1, wherein the vessel is a boiler fluidly coupled to a turbine.

3. The method of claim 1, wherein the portion of the exhaust gas is sufficient to lower the pH of the cooling medium.

4. The method of claim 3, wherein the vessel is a natural gas fired boiler.

5. The method of claim 1, wherein the portion of the exhaust gas is sufficient to raise the pH of the cooling medium.

6. The method of claim 5, wherein the vessel is a coal fired boiler.

7. The method of claim 1, wherein condensing comprises contacting a fluid conduit containing the fluid with the cooling medium.

8. The method of claim 1, wherein the cooling medium comprises reclaimed water.

9. A system comprising:

a vessel comprising a combustion heat source and a flue for exhausting a combustion exhaust gas generated by the combustion heat source;

a turbine;

a condenser;

a fluid conduit circuit containing a fluid that is fluidly coupled between the vessel, the turbine and the condenser;

a cooling circuit;

wherein the cooling circuit contains a cooling medium; and wherein the condenser transfers heat from the fluid to the cooling medium; and a diverter coupled to the flue to direct a portion of the exhaust gas from the flue to directly contact and mix with the cooling medium in the cooling circuit before the cooling medium enters the condenser to cool the fluid.

10. The system of claim 9, wherein the cooling medium is water and the portion of the exhaust gas that is directed to contact and mix with the cooling medium is sufficient to modify the pH of the cooling medium.

11. The system of claim 9, wherein the cooling medium is water and the portion of the exhaust gas that is directed to contact and mix with the cooling medium is sufficient to lower the pH of the cooling medium.

12. The system of claim 11, wherein the vessel is a natural gas fired boiler.

13. The system of claim 9, wherein the cooling medium is water and the portion of the exhaust gas that is directed to contact and mix with the cooling medium is sufficient to raise the pH of the cooling medium.

14. The system of claim 13, wherein the vessel is a coal fired boiler.

15. The system of claim 9, wherein water in the vessel does not mix with the cooling medium.

16. The system of claim 1, wherein the cooling medium comprises reclaimed water.

17. The system of claim 9, wherein the portion of the exhaust gas from the flue that directly contacts and mixes with the cooling medium contacts and mixes with the cooling medium in a cooling tower.

18. The system of claim 17, wherein the portion of the exhaust gas from the flue that directly contacts and mixes with the cooling medium contacts and mixes with the cooling medium in a basin of the cooling tower.

* * * * *